United States Patent [19]

Pichette

[11] Patent Number: 4,761,928

[45] Date of Patent: Aug. 9, 1988

[54] INSULATING BATTS SAG PREVENTING WALL FRAME STUD

[76] Inventor: Carold Pichette, 163 de l'Eglise Street, Château Richer, Canada, G0A 1N0

[21] Appl. No.: 69,975

[22] Filed: Jul. 6, 1987

[51] Int. Cl.[4] ..... E04B 1/62; E04B 2/14

[52] U.S. Cl. ..... 52/404; 52/715; 52/735; 52/DIG. 6

[58] Field of Search ..... 52/404, 407, 712, 714, 52/735, DIG. 6, 715, 736

[56] References Cited

U.S. PATENT DOCUMENTS

| | | | |
|---|---|---|---|
| 2,256,961 | 9/1941 | Pearson et al. | 52/407 |
| 3,908,328 | 9/1975 | Nelsson | 52/735 |
| 3,940,899 | 3/1976 | Balinski | 52/735 |
| 4,194,336 | 3/1980 | Weinar | 52/735 |
| 4,512,130 | 4/1985 | Pepin | 52/404 |
| 4,653,241 | 3/1987 | Bindi | 52/404 |

FOREIGN PATENT DOCUMENTS

| | | | |
|---|---|---|---|
| 495590 | 11/1938 | United Kingdom | 52/735 |

*Primary Examiner*—J. Karl Bell

[57] ABSTRACT

A metal stud for building walls, of substantially cross-sectionally U-shape, defining a channel, and that has integral jagged finger-shaped portions or prongs punched out of the web of the stud and which can be bent transversely to the web immediately prior to use, to enable impaling and anchoring of glassfiber-insulating batts, so as to support and retain the latter in place between the studs. The studs may be posts, ceiling joists, or transverse beams. The prongs preferably include a few barbs along a longitudinal edge, so as to contribute in the anchoring of the insulating batts to the studs. The prongs of the posts, when bent, are inclined relative to the web, so as to extend at an angle through the batt and, thus, across several of the easily-separable layers of fibers constituting said batts. Similar prongs are provided in horizontal beams interconnecting the posts. The barbs are also transversely upwardly inclined for easier and better anchoring. The beams and posts also retain rods inserted through the batts to anchor the edge portions thereof.

11 Claims, 4 Drawing Sheets

12
50
24
B
64
14
BF
18
45
28
40
42
44
46
48
47
38
65
66

INSULATING BATTS SAG PREVENTING WALL FRAME STUD

FIELD OF THE INVENTION

This invention relates to wall frame constructions for buildings and, more particularly, to wall frame studs provided with novel means to support and retain insulating fiber batts between the studs.

BACKGROUND OF THE INVENTION

In the construction industry, it is nowadays a conventional operation to add insulating materials to the inner walls of a room, ceiling, crawl space, basement or exterior wall of a building. Such insulating materials may be installed for their sound-proof features: this is often the case in rooms of high-class, high-rise commercial buildings, for privacy of communications between the occupants. Alternately, or concurrently, such insulating materials may be installed for their thermal shielding features: this insulation is necessary in all the exterior walls of buildings located in countries, such as Canada, where winter months are very cold.

Such insulating materials are mounted between the vertical and horizontal studs making the wall frame. Batts or flexible glassfibers are often used. Previously such batts were adhered to one or two paper sheets which served as a means to secure the batts in place. However, paper covering is now discontinued for fire prevention.

It is well known that, if not secured in place, batts of glassfibers, being of a flexible nature, tend with time to sag or drop from their original position in the cavity of the wall in which they are embedded; this is increasingly so with increasingly thicker batts.

There are many reasons why flexible insulating batts drop in their wall cavity. Some of the most common reasons are due to job conditions during construction, vibration, moisture, and water absorbed due to natural atmospheric conditions and job hazards, use of inadequate support members, and many other on-the-job conditions where friction-fit products cannot perform as required. The problem is greater in the case of walls of a height exceeding eight feet, whether partition walls or peripheral walls.

Of course, insulation sagging means loss of thermal or sound insulation in the exposed areas. To the quality-of-work conscious construction worker, this is not acceptable.

Attempts have been made in the art to tackle this problem. Generally, such improvements include either glueing the batts to a backing surface or securing metal strips transversely and in vertically-spaced-apart fashion as add-on elements to the wall frame, the strips being provided with sharpened prong members adapted to engage into the insulating batts, in order to more securely hold the batts in position.

Glueing or installation of add-on transverse strips require additional labour and inspection. Also the strips cannot retain the edges of the batts.

OBJECTS OF THE INVENTION

The gist of the present invention is to provide improved means for supporting and retaining flexible insulating batts into building wall constructions.

A corollary object of the invention is that the insulating batts support and retaining features of the invention are very long lasting and most effective.

Other objects of the invention are that the abovementioned means are economical in manufacturing costs, sturdy in construction, and that it is easier and safer to install.

A further object of the invention is that said supporting and retaining means are good for thermal- as well as sound-insulating batts.

SUMMARY OF THE INVENTION

In accordance with the objects of the invention, there are disclosed wall frame components for supporting and retaining insulating batts. The wall frame components comprise: spaced posts and beams to interconnect the posts in parallel spaced-apart fashion.

Each post is substantially cross-sectionally U-shaped, defining a base wall and two side walls, an inner channel being thereby formed in each post, the base walls of successive pairs of posts being generally parallel. Means are provided to support and retain a pair of opposite insulating batts to anyone of said posts, such latter means comprising: elongated prongs, struck out from the base wall but integrally connected thereto about a fold line for relative movement of the prongs between a first inoperative position, co-planar with said post base wall, and a second operative position, transverse to said post base wall and where the prongs may extend in opposite directions, so as to be adapted to impale two insulating batts on both sides of the post. Preferably, the fold lines are inclined relative to the long axis of the post, so that when the prongs are in operating position, they are transversely upwardly inclined and their upper longitudinal edge has barbs to more firmly anchor the batts. Also, when in operating position, the prongs are inclined relative to the base wall of the posts to extend at an angle through the thickness of the batts and, thus, through several of the easily-separable leyrs of fibers constituting the batt. Thus, the whole of the batt is retained by the prongs.

Advantageously, the beams include a ceiling joist, being cross-sectionally U-shaped to define a base wall and two side walls to form a channel, the posts top end engaging the latter channel and fixedly secured thereto by screw means. Prongs are also provided, mounted to said joist for supporting and retaining said insulating batts, said prong members formed by struck-out portions, made in one joist side wall and integral with the joist side wall at one of the ends thereof, forming a fold line, for relative movement of the prong between a first inoperative position, coplanar with the corresponding joist side wall, and a second operative position, transverse to the latter joist side wall and where the second prong is adapted to impale a registering insulating batt.

Preferably, the prongs, when in operative position, are upwardly inclined to better retain the batts.

Alternately or concurrently, it would be profitable that the posts interconnecting means include at least one transverse beam, being substantially cross-sectionally U-shaped to define a base wall and two side walls to form a channel and also one or two outturned flanges about the longitudinal edges of the latter side wall, said flanges abutting against and fixedly secured by screw means to the registering section of each upright post side wall, whereby the transverse beam channel defines a plane at right angle to that of the corresponding post channel. Prongs are also provided on said transverse beams, for supporting and retaining registering insulating batts, said prongs also formed by struck-out portions, made in an intermediate section of the transverse beam flanges and integral with the flanges at one of the ends thereof, forming a fold line, for relative movement of the prongs between a first operative position, coplanar with the corresponding transverse beam flange, and a second operative position, transverse to said beam flanges and adapted to impale a registering insulating batt.

Preferably, the prongs of the transverse beams are also upwardly inclined, when in operative position to better support the insulating batts.

Preferably, the posts and ceiling joists include integral eyelets registering in pairs for retaining short wires inserted in the edge portions of the batts and anchoring said edge portins.

Preferably, there are also provided anchoring plates with struck-out prongs for retaining the batts at their butt joints.

DETAILED DESCRIPTION OF THE EMBODIMENT OF THE INVENTION

Figures 1, 2, 3:
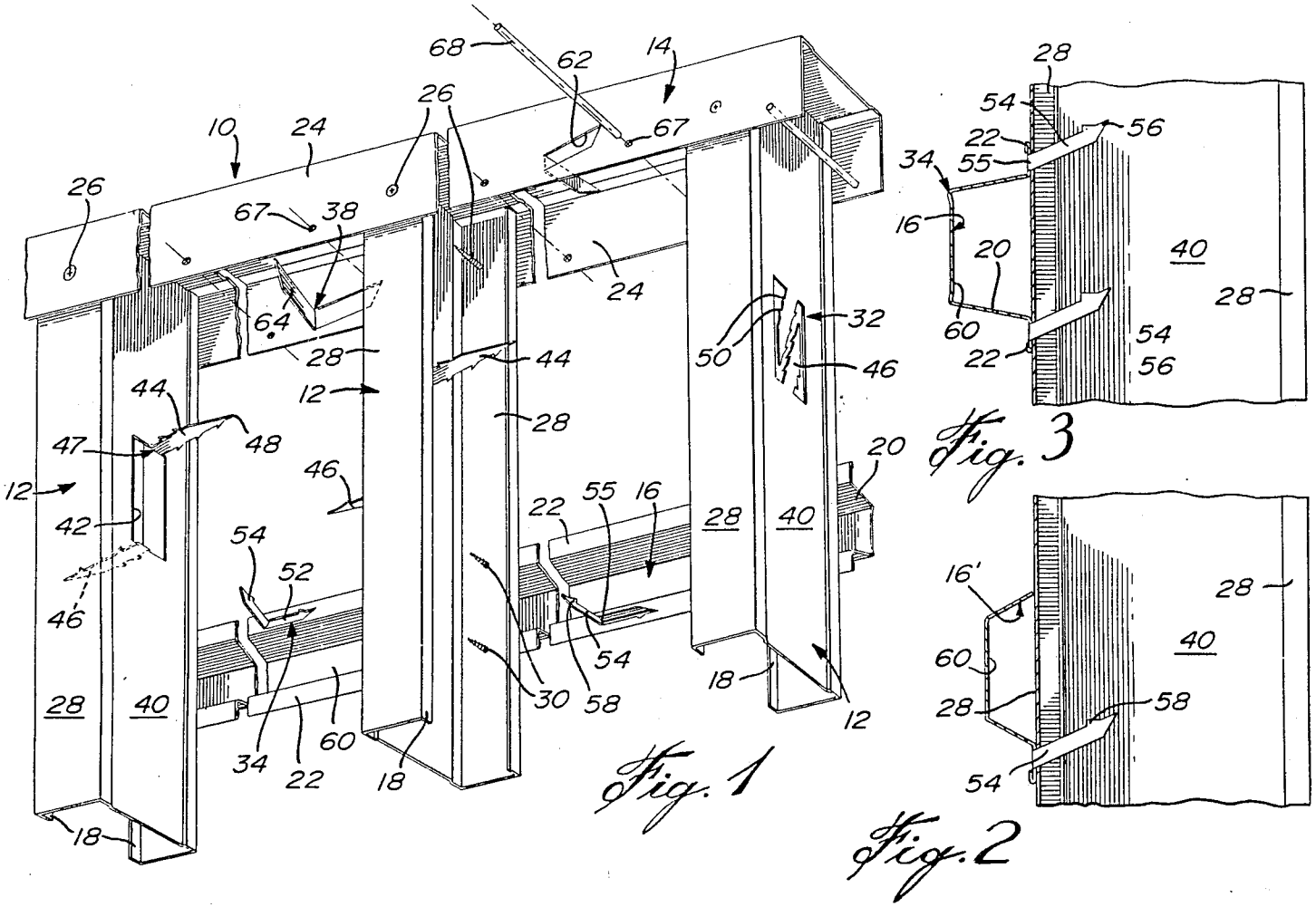
FIG. 1 is a fragmentary perspective view of a building wall frame, constructed in accordance with the teachings of the invention, and with the prongs thereof in extended operative position ready for impaling insulating batts to be supported and retained against sagging within the wall.
FIG. 2 is a longitudinal fragmentary section of a post with a transverse beam according to one embodiment, in cross-section, and at an enlarged scale relative to FIG. 1.
FIG. 3 is the view of FIG. 2 but for an alternate embodiment of a transverse beam.
Figures 4, 5, 6:
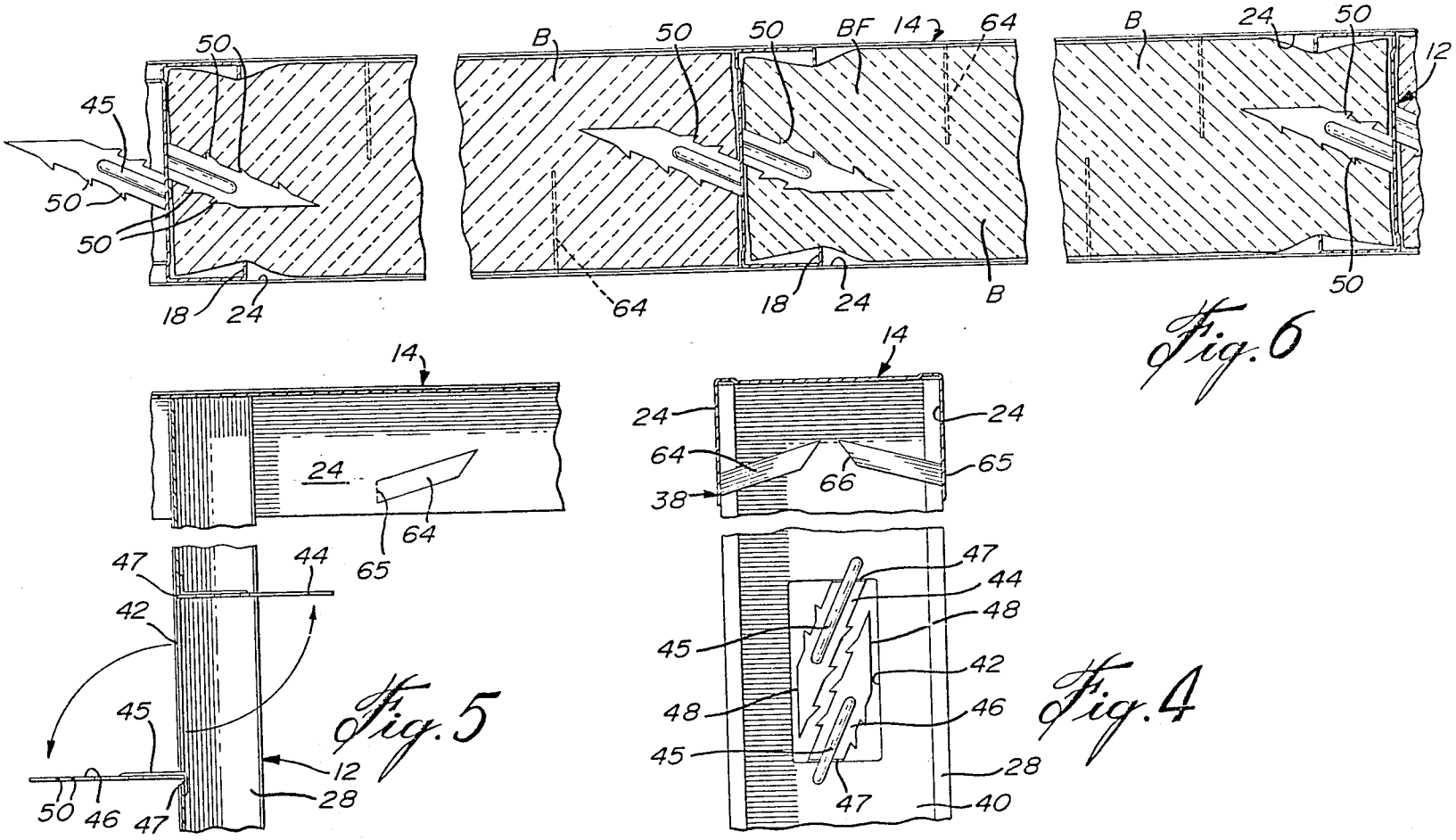
FIG. 4 is a fragmentary view of interconnected post and ceiling joist, the post in elevation and the joist in cross-section, and with the joist prongs in extended operative position.
FIG. 5 is a longitudinal section of a fragmentary post and ceiling joist with the post prongs in extended operative position.
FIG. 6 is a bottom plan view of a ceiling joist and associated posts in cross-section, but including insulating batts shown herein supported by the post and joist prongs in their extended operative position.

The wall metal frame 10 of a building, fragmentarily shown in FIG. 1, conventionally consists inter alia of a plurality of upright wall posts 12, arranged in spaced parallel relation. Ceiling joists 14 are provided to interconnect the top ends of a number of vertical posts 12, and also transverse beams 16, and/or 16' interconnecting the side edges of intermediate sections of the vertical posts 12. Floor joists (not shown) are also provided, similar to ceiling joists 14; floor joists receive the bottom ends of posts 12. Dry wall panels (not shown) are secured to one or both sides of wall frame 10 to complete a wall. Each element 12, 14, 16, 16' is substantially cross-sectionally U-shaped, to form channels, with channel 16 being substantially smaller than channels 12 and 14, and with post 12 being only slightly smaller than joist 14, so as to engage into its channel 14. The two longitudinal free edges of posts 12 each forms a small inturned flange 18. The two side walls 20 of each transverse beam 16 each defines an outturned flange 22. In beam 16', only one outturned flange 22 is provided. Beams 16' are used for sound-proofing purposes, their side wall opposite flange 22 is perforated.

Channels 12 and 14 are adapted to be engaged by insulating batts B, which fill the space between posts 12 and between the dry wall panels.

The side walls 24 of ceiling joist 14 are connected by screws 26 to both side walls 28 of posts 12, while the outturned flanges 22 of each transverse channel member 16 are connected by screws 30 to a corresponding one of the side walls 28 of each post 12. Conventionally, the threaded body of screws 26, 30, which extend on the side of the channels of upright posts 12, impale the insulating batts B, engaged therein; but this is not sufficient to prevent sagging of the batts B.

According to the specific features of the invention, each of metal studs 12, 14, 16, 16' (which are conventional per se) includes a few struck-out portions about intermediate sections thereof.

A first struck-out portion 32, shown in FIG. 1, is made into the base wall or web 40 of posts 12. Each struck-out portion 32 defines a substantially rectangular aperture 42 in web 40, and a pair of opposite, elongated prongs 44 and 46, integral by their small inner ends with opposite small side edges of aperture 42 forming a fold line 47. Each prong 44, 46 has a bevelled free end tip 48 and a few intermediate barbs 50; is shorter than the long edges of aperture 42; and converges toward a corresponding long side edge of aperture 42, wherein tip 48 extends slightly short of a registering corner of aperture 42.

Thus, each pair of prongs 44, 46, in a given aperture 42, extend about axes substantially parallel to each other, obliquely by about 30 degrees from an axis parallel to the long sides of aperture 42. When studs 12 are manufactured prongs 44, 46, from first struck-out portion 32, are made coplanar to base wall 40 thereof, to prevent bodily injuries during handling of the studs 12. However, when studs 12 are installed, prongs 44, 46 are selectively pivoted about their inner end or fold line 47, to a second operative position, orthogonal to both the planes of side walls 28 and to the plane of base wall 40, the top one 44 extending in one direction, the bottom one 46 in the opposite direction. In such a position, the two prongs 44, 46 are designed to impale a pair of opposite insulating batts B, which are installed between posts 12, abutting the base walls of posts 12 and joist 14. This impaling is most effective because of the relative inclination of each pair of prongs 44, 46 constituting an anchoring member which minimizes occurrence of tear of the insulating batts B.

Such batts B are made of glassfibers in which the fibers are generally oriented in the main plane of the rectangular batt. Thus, the batt forms easily-separable layers.

When in operating position, prongs 44, 46, because of their inclination relative to the plane of wall frame 10, extend across several layers of batts B and, thus, more firmly anchor the batts than if they were to extend parallel to the layers, in which case the layers would separate on each side of the prongs.

Each prong 44, 46 includes barbs 50 on longitudinal edges thereof to more firmly anchor into batts B. Each prong 44, 46 may be reinforced by a longitudinal, central rib 45 formed by upsetting the metal of the prong, and extending beyond fold-line 47 at one end and short of the level of the outermost barb 50 at the other end. Preferably, fold-line 47 is formed by a smaller rib than rib 45 which locates the foldline.

Of course, prongs 44, 46 are bent on the site only when batts B are to be installed.

The second struck-out portion 34, shown in FIGS. 1 and 3, is made in the outturned flange 22 of transverse beam 16. It defines an aperture 52, which corresponds to the shape of a single prong 54. Prong 54 is substantially rectangular, with a short bevelled tip 56 and a barb 58 on its edge opposite to the registering side wall 20 of beam 16. The inner edge of prong 54 is integral with flange 22, and constitute a fold line 55 about which the prong can be bent from a first position, wherein it is coplanar with flange 22, to a second position extending outwardly from flange 22 and inclined by about 30 degrees from an axis orthogonal to flange 22 on the outer side of the plane passing through the registering side wall 20, and parallel to base wall 60, and also adapted to impale batts B. As shown in FIG. 3, the two prongs 54 are upwardly inclined, whereby the sagging batts will tend to slide down along the prong and abut flange 22. In the transverse beams (FIG. 2), which have only one longitudinal outturned flange 22, there is only a single series of upwardly inclined prongs 54.

The ceiling joists 14 have struck-out portions 38, shown in FIGS. 1 and 4–6, made in the side walls 24. It defines an aperture 62 which corresponds to the shape of a single prong 64. Prong 64 is substantially rectangular, with a bevelled free end 66, the inclined edge portion thereof facing downwardly. The small inner edge of prong 64 is integral with side wall 24, and constitute a fold line 65 about which the prong can be bent from a first position, wherein it is coplanar with wall 24, to a second position, extending inwardly into channel 14 and upwardly inclined by about 30 degrees relative to the plane of side walls 24.

In a number of cases, beams 16 and 16' are not used and the dry wall panels are fixed directly to side walls 28 of posts 12. If beams 16 and/or 16' are used, the dry wall panels are then fixed to the web 60 of these beams.

As shown in FIG. 1, if found necessary, tie means are provided to firmly anchor the top edge portions of the batts B within the ceiling joists 14. For that purpose, a series of holes, indicated at 67, are made through the side walls of the joists 14 in registering pairs and short rods 68 are inserted through said holes and through the batts B. A similar arrangement is desirable for the posts 28, as shown in conjunction with posts 12' of FIGS. 7, 8 and 9. For such posts, the rods 68 are inserted through eyelets 69 and 69' in horizontally-registering pairs in the small flanges 18' and at the edges of the web 40' of the channel-shaped posts. Thus, the batts through which the rods 68 extend can be maintained close to the web 40' on oposite faces thereof.

Figure 7:
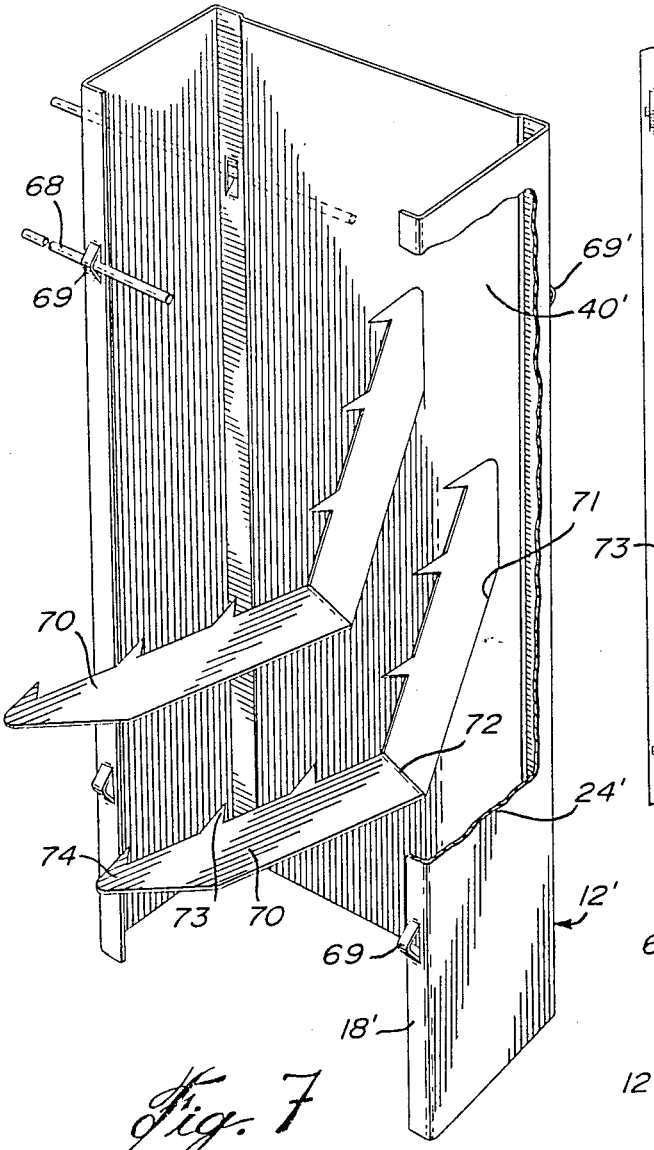
FIG. 7 is a perspective view of a portion of a post in accordance with a preferred embodiment of the invention, the prongs being in operative position.
Figure 9:
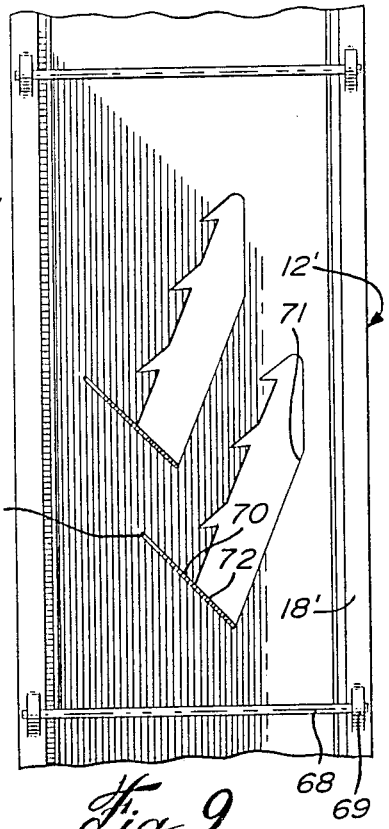
FIG. 9 is a front end elevation of the embodiment of FIG. 7.
Figure 8:
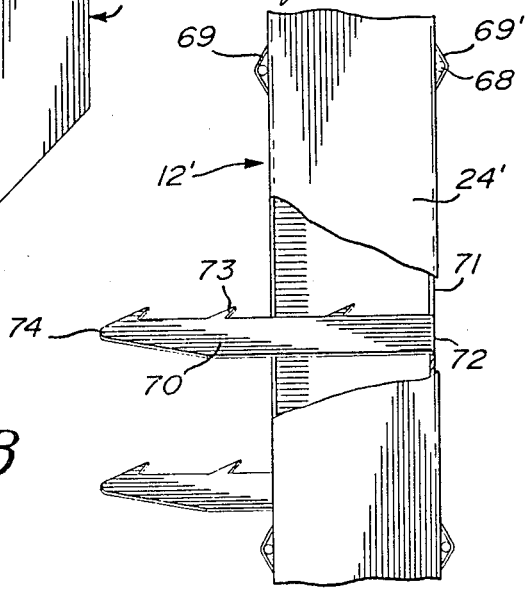
FIG. 8 is a side elevation partially cut away of the embodiment of FIG. 7.

FIGS. 7 to 9 inclusive also show a modified arrangement of the prongs as compared to the prongs 46 and 44 of the first embodiment. Prongs 70 are arranged in spaced pairs at spaced intervals along the post 12' and are each partially struck out from the web 40' so as to leave an aperture 71, each prong being integrally connected to the web 40' along the fold line 72. As clearly shown, not only is the longitudinal axis of each elongated prong 70 inclined with respect to the long axis of the post 12', but also the fold line 72 is inclined with respect to said post longitudinal axis and also to said prong longitudinal axis.

Therefore, when the prongs are bent to their operative position, they not only extend through several layers of the glass fibers of the batt, but also the plane of the prongs is inclined to the vertical. Their upper edge only is provided with a plurality of inwardly-directed barbs 73, and they have a tapered tip 74. It has been found that with this arrangement, anchoring of the glass fiber batts B is much more efficient than with the embodiment of FIG. 4 and prong insertion into the batt is also easier. The batts have simply to be pushed against the prongs 70 until tip 74 is exposed. Upon release, the batt tends to slide down along the transversely-inclined prong 70 until it abuts against side wall 24' of post 12. In FIG. 7, the two prongs are bent in the same direction; however, it is obvious that one prong will be bent in the opposite direction whenever there are batts B on opposite sides of the post 28'. The prongs 70 are preferably provided with longitudinal ribs, such as ribs 45, shown in FIG. 4, while the bending lines 72 are also provided with a smaller rib. which not only facilitates bending along the proper line but also causes easier bending in one direction than in the other.

Ribs 72 will be directed in opposite directions with respect to the web 40' for each pair of prongs 70, so that this will incite the user to bend each pair of prongs in opposite directions, so as to anchor batts B on opposite sides of the post.

Figure 11:
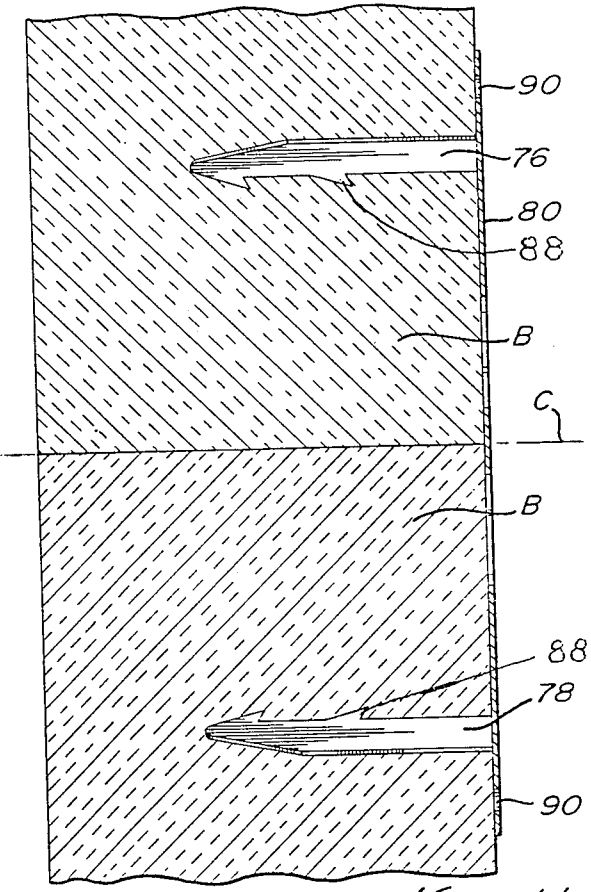
FIG. 11 is a section taken along line 11-11 of FIG. 10 and with the prongs inserted into two insulating batts.
Figure 10:
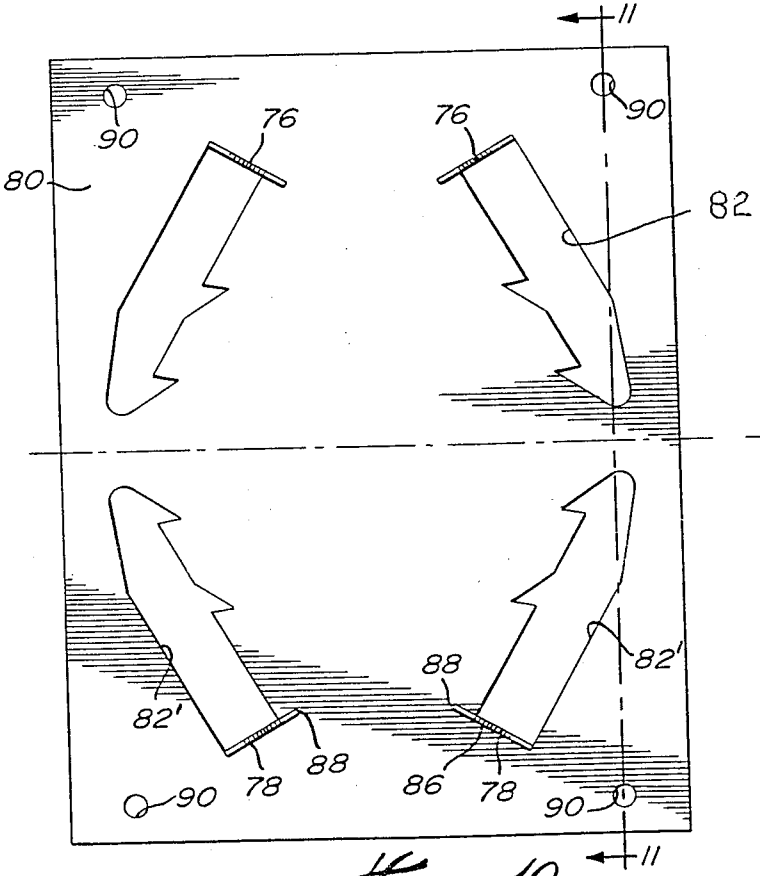
FIG. 10 is an elevation of an anchoring plate with the prongs in bent, operative position.

In FIGS. 10–11, an anchoring plate is shown with a modified arrangement of the prongs. These prongs 76, 78 are struck out from a quadrangular plate 80 to form a corresponding aperture 82, 82', respectively.

Their fold line 86 is normal to their longitudinal axis. Each prong has barbs 88 along only one longitudinal edge. The barbs 88 of the pair of prongs 76 face one another and prongs 76 diverge from each other from their fold line 86. The same applies to the pair of prongs 78.

Once prongs 76, 78 are bent to their operative position (FIG. 10), plate 80 is applied against two batts B across their butt joint C, with the prongs inserted within the batts. The plate 80 can be applied in any orientation; in all cases, those prongs, with their barbs 88 uppermost, transversely, downwardly diverge, so as to exert a slight tension in the batt under the weight of the upper batt. Thus, the joint is sealed and also the two batts are maintained co-planar. Plate 80 has holes 90 at the four corners to fix by screws the plate to the side wall 24 of ceiling joist 14, so as to retain the batts within said joist.

I claim:

1. A structural, sheet metal elongated member adapted to be used as a component of a wall frame defining a cavity for receiving glass-fibre insulating batts of the type having easily-separable layers, said member of U-shape cross-section defining a web and two legs interconnecting said web and of a width at least one-quarter that of said web, said member used as an upright stud, said stud having longitudinally-spaced struck-out portions made in said web, each defining an elongated prong having a free tip and free longitudinal edges and an inner end integrally-connected to said web at a bending line, said prong bendable between an inoperative position co-planar with said web and an operative position generally normal to said web to engage and retain a batt , said bending line being oblique to the longitudinal axis of said member and said prong, when in operative position, being transversely, downwardly inclined towards one of said legs, and at least one of its longitudinal edges being inclined relative to the plane of said web.

2. A structural member as in claim 1, wherein the longitudinal axis of said prong is oblique to the longitudinal axis of said member when said prong is in inoperative position.

3. A structural member as defined in claim 2, wherein only one of said longitudinal edges of said prong is provided with spaced barbs directed towards said bending line.

4. A structural member as in claim 2, further including a reinforcing rib longitudinally extending in said prong and said bending line being formed by a second rib transverse to said reinforcing rib.

5. A structural member as defined in claim 1, wherein said prongs are arranged in pairs and extend in opposite direction from said web when in operative position, to thereby impale said batts on opposite sides of said stud.

6. An anchor plate for retaining a pair of flexible fiber-insulating batts forming a butt joint, said anchor plate adapted to be applied against said batts across said joint for maintaining said batts against relative movement; said anchor plate made of sheet metal and having two pairs of elongated prongs, each having a free tip, free longitudinal edges and integrally connected to said plate at a bending line, the bending lines of each pair of prongs mutually converging, each prong having barbs along its longitudinal edge which is closer to the other prong of the pair, the other longitudinal edge of each prong being devoid of barbs, said prongs bendable about their respective bend lines for relative movement of the prongs between a first inoperative position, coplanar with said anchor plate, and a second operative position, transverse to said anchor plate to be inserted into said batts with the prongs of one pair into one batt, and the prongs of the other pair into the other batt.

7. A wall structure comprising, in combination, at least three upright spaced substantially parallel studs, a horizontal ceiling joist extending transversely and over the top ends of said studs and interconnecting the same, said studs and joist made of sheet metal, each stud of U-shape cross-section defining a web and two legs interconnecting said web, and of a width at least one-quarter that of said web, the webs of the studs disposed in parallel planes substantially normal to the general plane of the wall structure, wall panels fixed to the legs of said studs on at least one side of said studs, glass-fibre insulation batts filling the space between the studs, said batts extending on opposite faces of the web of at least one of said studs, said batts formed of easily-separable layers of glass-fibres disposed in the general plane of said wall panels, the web of each stud having partially struck-out elongated prongs having a free tip, free longitudinal edges and an inner end integrally-connected to said web by a bending line, which is downwardly inclined towards said wall panels relative to the longitudinal axis of said stud, said prongs bent about their bending line to an operative position in which the plane of said prongs is generally normal to said web, in which said prongs are transversely downwardly inclined towards said wall panels and in which at least one longitudinal edge of said prongs is inclined relative to the plane of said web, whereby said prongs impale said batts across at least some of said separable layers, and a portion of said batts overlying said prongs tends to be displaced by said transversely-inclined prongs towards said wall panels.

8. A wall structure as defined in claim 7, wherein the prongs of said one stud are arranged in pairs and extend in opposite directions from said web of said one stud and impale said batts on opposite sides of said one stud.

9. A wall structure as defined in claim 7, wherein the bending line of each prong is oblique to the longitudinal axis of said stud and also to the longitudinal axis of said prong.

10. A wall structure as defined in claim 9, wherein the longitudinal axis of each prong is oblique to the longitudinal axis of said stud, when said prong is in inoperative position substantially co-planar with the web of said stud.

11. A wall structure as defined in claim 7, wherein said ceiling joist is substantially cross-sectionally U-shaped, defining a base wall and two side walls to form a channel, the top ends of said post engaging said channel and fixedly secured therein, said insulating batts extending within said channel at their top end, at least one side wall of said ceiling joist having partially struck-out elongated prongs having a free tip, free longitudinal edges and an inner end integrally connected to said ceiling joist side wall by a bending line, said last-named prong bendable about said bending line to take an operative position substantially normal to said ceiling joist side wall and extending within said channel and impaling said batts, said prongs in said operative position having a top longitudinal edge which is upwardly inclined from said ceiling joist side wall to the free tip of said last-named prong.

* * * * *